US008204399B2

(12) United States Patent
Gross et al.

(10) Patent No.: US 8,204,399 B2
(45) Date of Patent: Jun. 19, 2012

(54) METHOD AND APPARATUS FOR AUTOMATIC COROTRON CLEANING IN AN IMAGE PRODUCTION DEVICE

(75) Inventors: Robert Arnold Gross, Penfield, NY (US); Michael Nicholas Soures, Webster, NY (US); John Chinnici, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 983 days.

(21) Appl. No.: 12/182,246

(22) Filed: Jul. 30, 2008

(65) Prior Publication Data

US 2010/0028040 A1 Feb. 4, 2010

(51) Int. Cl.
*G03G 15/02* (2006.01)

(52) U.S. Cl. ..... 399/100

(58) Field of Classification Search ..... 399/100, 399/168, 170, 171, 172
See application file for complete search history.

(56) References Cited

U.S. PATENT DOCUMENTS 5,485,255 A 1/1996 Reuschle et al.
6,449,447 B1 9/2002 Regelsberger et al.
2003/0219265 A1* 11/2003 Matsumoto et al. ..... 399/38
2006/0093390 A1* 5/2006 Sasai ..... 399/91
2007/0065173 A1 3/2007 Sekovski et al.

* cited by examiner

*Primary Examiner* — David Gray
*Assistant Examiner* — Billy J Lactaoen
(74) *Attorney, Agent, or Firm* — Ronald E. Prass, Jr.; Prass LLP

(57) ABSTRACT

A method and apparatus for automatic corotron cleaning in an image production device is disclosed. The method may include receiving a first dynamic current reading, the dynamic current being the current supplied to a photoreceptor of the image production device, determining if the first dynamic current reading exceeds a predetermined threshold, the predetermined threshold being a threshold set on the allowable variation in the dynamic current value, wherein if it is determined that the first dynamic current reading exceeds the predetermined threshold, sending a signal to a cleaning device to clean the corotron, determining that the corotron has been cleaned, receiving a second current reading, determining if the second dynamic current reading exceeds the predetermined threshold, wherein if it is determined that the second dynamic current reading exceeds the predetermined threshold, sending a signal to prompt a user to replace the corotron in the image production device.

18 Claims, 5 Drawing Sheets

METHOD AND APPARATUS FOR AUTOMATIC COROTRON CLEANING IN AN IMAGE PRODUCTION DEVICE

BACKGROUND

Disclosed herein is a method for automatic corotron cleaning in an image production device, as well as corresponding apparatus and computer-readable medium.

In an image production device, when the transfer corotron gets dirty or there is a buildup of contaminates on the wire or shield, non-uniform corona is emitted that can cause a variety of print defects ranging from density variation to white spots. In conventional image production devices, the corotron has an automatic wire cleaner that is actuated at predetermined print counts when the machine is in a cycle down mode. However, dirt and contaminate buildup is not just a function of just print count but may be a result of the types of print jobs performed, system conditions, and the environment.

SUMMARY

A method and apparatus for automatic corotron cleaning in an image production device is disclosed. The method may include receiving a first dynamic current reading, the dynamic current being the current supplied to a photoreceptor of the image production device, determining if the first dynamic current reading exceeds a predetermined threshold, the predetermined threshold being a threshold set on the allowable variation in the dynamic current value, wherein if it is determined that the first dynamic current reading exceeds the predetermined threshold, sending a signal to a cleaning device to clean the corotron, determining that the corotron has been cleaned, receiving a second current reading, determining if the second dynamic current reading exceeds the predetermined threshold, wherein if it is determined that the second dynamic current reading exceeds the predetermined threshold, sending a signal to prompt a user to replace the corotron in the image production device.

DETAILED DESCRIPTION

Figure 1:
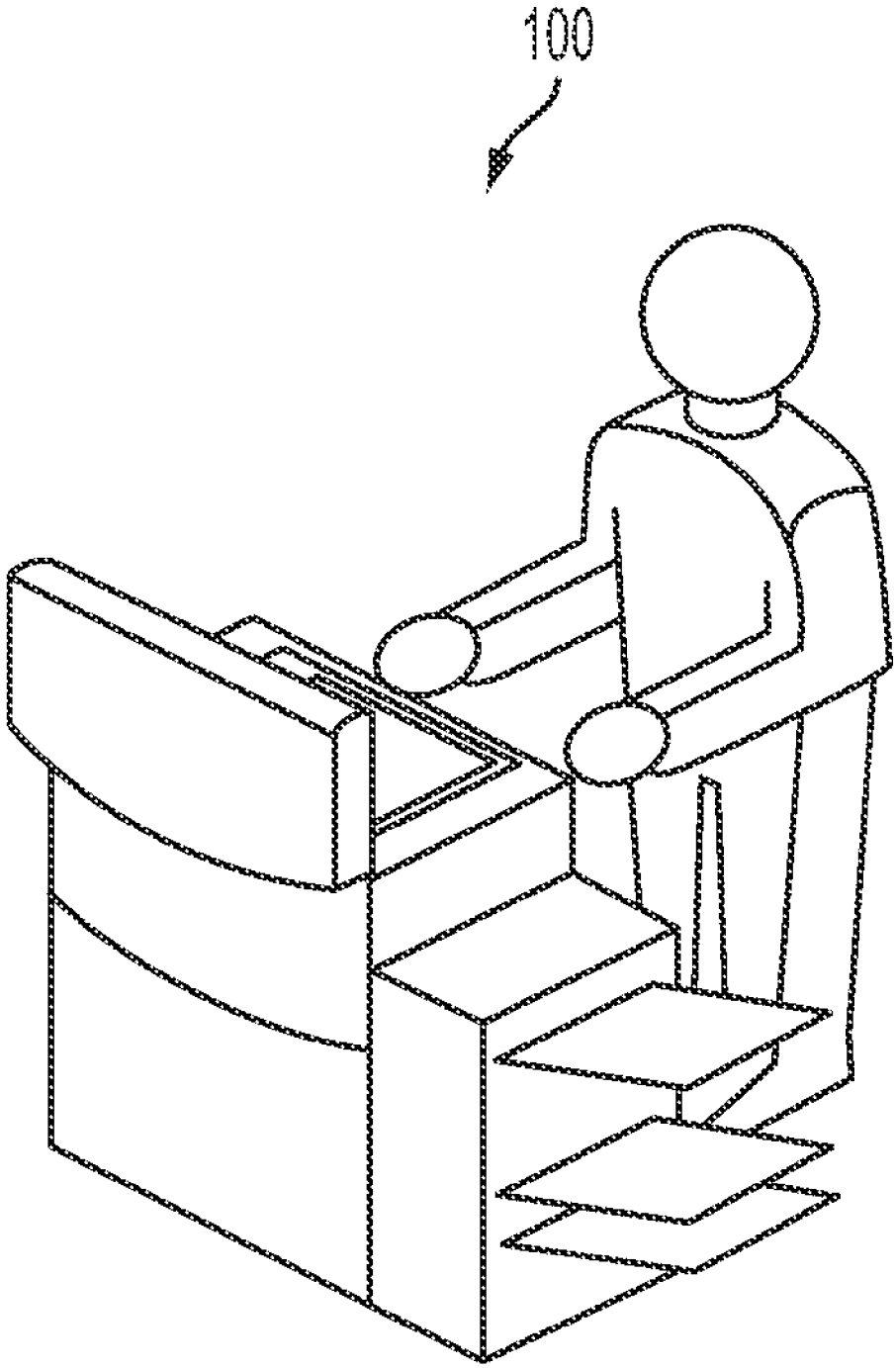
FIG. 1 is an exemplary diagram of an image production device in accordance with one possible embodiment of the disclosure.

Aspects of the embodiments disclosed herein relate to a method for automatic corotron cleaning in an image production device, as well as corresponding apparatus and computer-readable medium.

The disclosed embodiments may include a method for automatic corotron cleaning in an image production device. The method may include receiving a first dynamic current reading, the dynamic current being the current supplied to a photoreceptor of the image production device, determining if the first dynamic current reading exceeds a predetermined threshold, the predetermined threshold being a threshold set on the allowable variation in the dynamic current value, wherein if it is determined that the first dynamic current reading exceeds the predetermined threshold, sending a signal to a cleaning device to clean the corotron, determining that the corotron has been cleaned, receiving a second current reading, determining if the second dynamic current reading exceeds the predetermined threshold, wherein if it is determined that the second dynamic current reading exceeds the predetermined threshold, sending a signal to prompt a user to replace the corotron in the image production device.

The disclosed embodiments may further include an image production device that may include a dynamic current monitor that monitors the dynamic current from the transfer power supply, the dynamic current being the current supplied to a photoreceptor of the image production device, and a corotron management unit that receives a first dynamic current reading from the dynamic current monitor, determines if the first dynamic current reading exceeds a predetermined threshold, the predetermined threshold being a threshold set on the allowable variation in the dynamic current value, wherein if the corotron management unit determines that the first dynamic current reading exceeds the predetermined threshold, the corotron management unit sends a signal to a cleaning device to clean the corotron and determines that the corotron has been cleaned, receives a second current reading from the dynamic current monitor, determines if the second dynamic current reading exceeds the predetermined threshold, wherein if the corotron management unit determines that the second dynamic current reading exceeds the predetermined threshold, the corotron management unit sends a signal to prompt a user to replace the corotron in the image production device.

The disclosed embodiments may further include a computer-readable medium storing instructions for controlling a computing device for automatic corotron cleaning in an image production device. The instructions may include receiving a first dynamic current reading, the dynamic current being the current supplied to a photoreceptor of the image production device, determining if the first dynamic current reading exceeds a predetermined threshold, the predetermined threshold being a threshold set on the allowable variation in the dynamic current value, wherein if it is determined that the first dynamic current reading exceeds the predetermined threshold, sending a signal to a cleaning device to clean the corotron, determining that the corotron has been cleaned, receiving a second current reading, determining if the second dynamic current reading exceeds the predetermined threshold, wherein if it is determined that the second dynamic current reading exceeds the predetermined threshold, sending a signal to prompt a user to replace the corotron in the image production device.

The disclosed embodiments may concern an automatic corotron cleaning process. This process proposes that when the transfer power supply's monitored dynamic current exceeds a predetermined maximum variation, a command may be sent to exercise the corotron auto-cleaner at the next available queue.

In addition, the disclosed embodiments may concern using the dynamic current monitor function of the power supply to determine if the corotron was not restored to an acceptable condition after auto-cleaning. If not the corotron was not restored to an acceptable condition, then a flag for corotron replacement would be activated.

The benefits of this automatic corotron cleaning process may include:

More consistent print quality

Only exercising the auto-cleaner when needed (to avoid auto cleaner failures)

Achieve maximum corotron life rather than replacing at a specified HSFI

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

Figure 2:
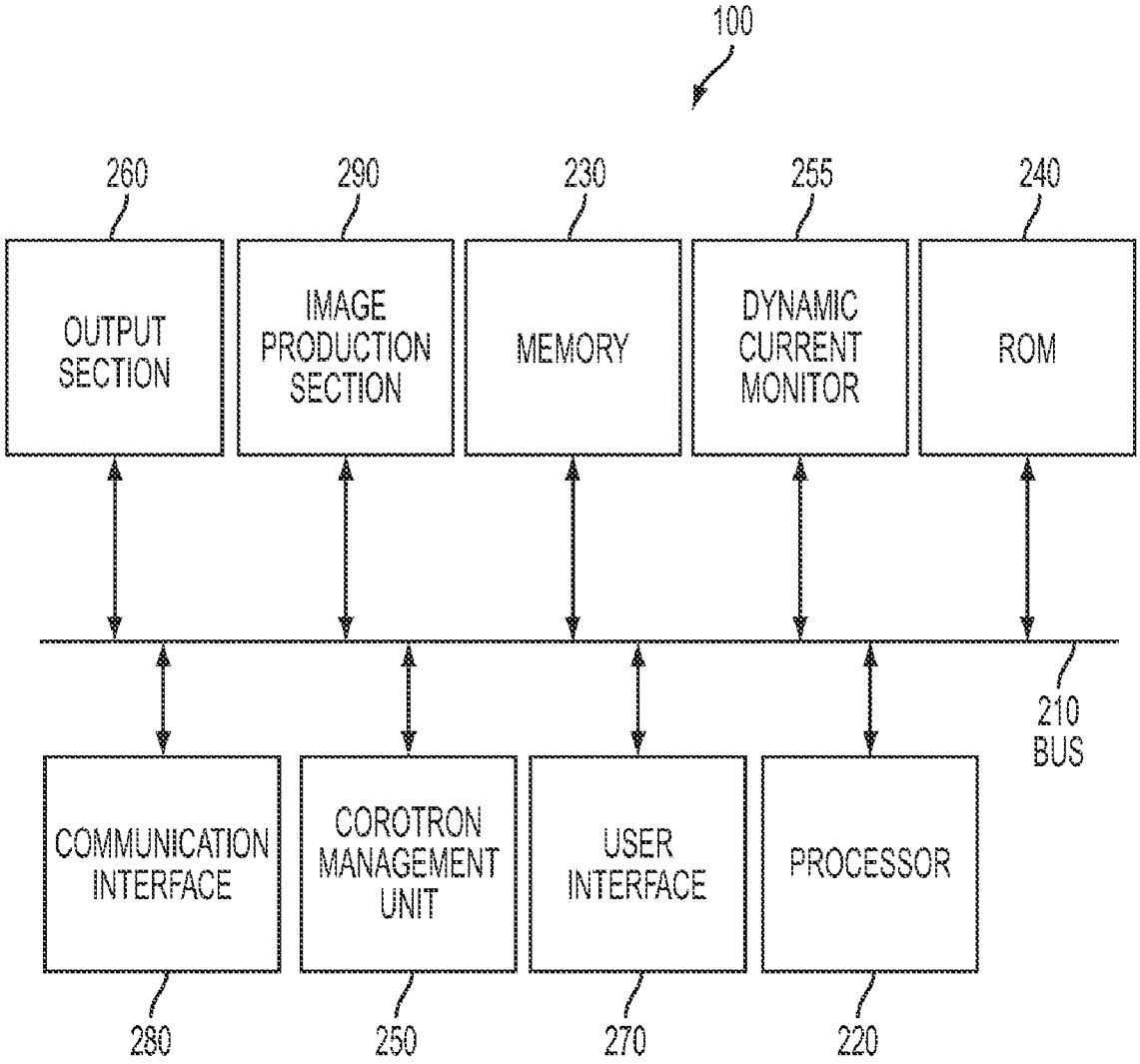
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a corotron management unit 250, a dynamic current monitor 255, an output section 260, a user interface 270, a communication interface 280, and an image production section 290. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 270 may include one or more conventional mechanisms that permit a user to input information to and interact with the image production unit 100, such as a keyboard, a display, a mouse, a pen, a voice recognition device, touchpad, buttons, etc., for example. Output section 260 may include one or more conventional mechanisms that output image production documents to the user, including output trays, output paths, finishing section, etc., for example. The image processing section 290 may include an image printing and/or copying section, a scanner, a fuser, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Figure 3:
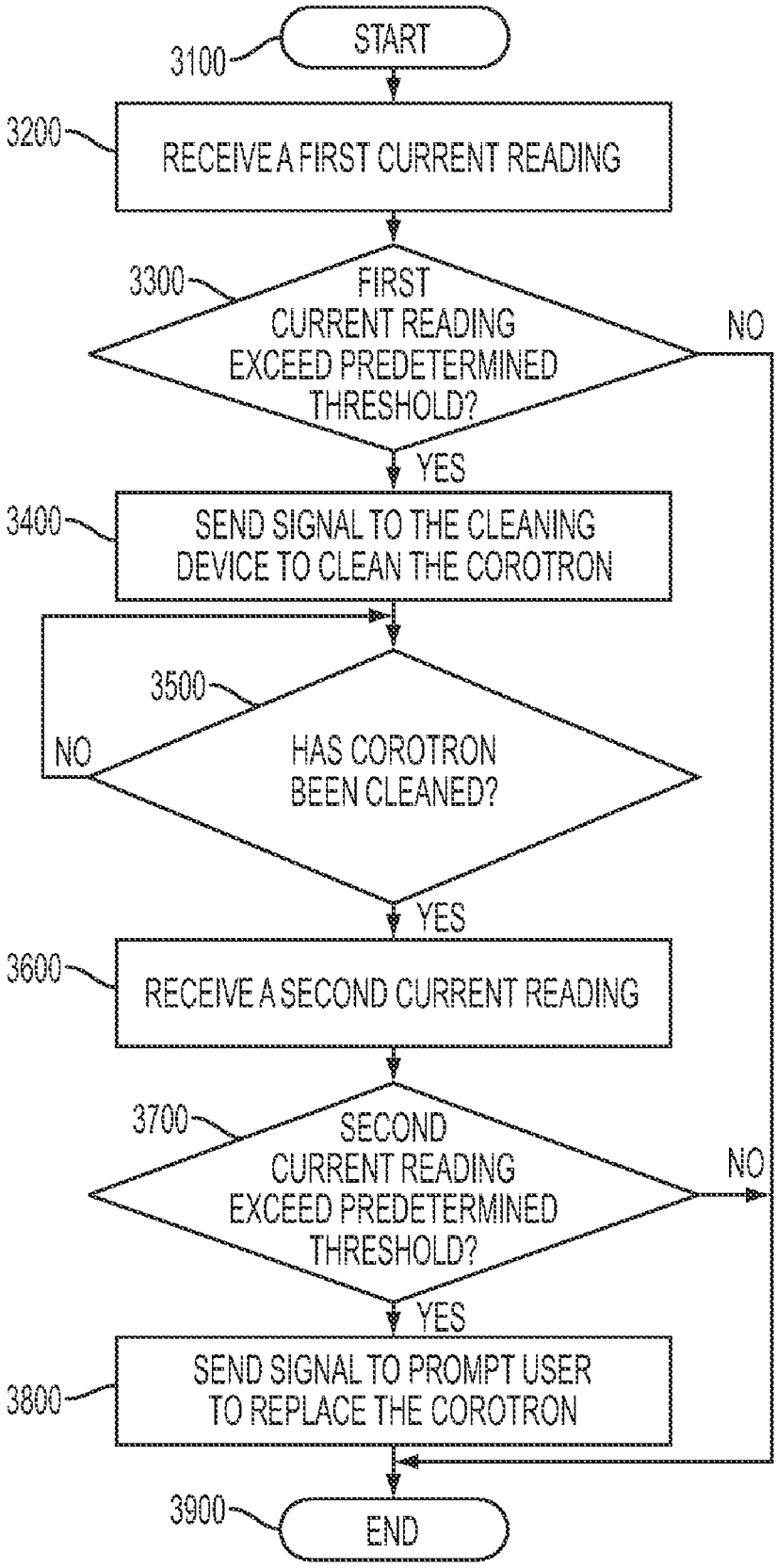
FIG. 3 is a flowchart of an exemplary automatic corotron cleaning process in accordance with one possible embodiment of the disclosure.

The operation of the dynamic current monitor 255, the corotron management unit 250, and the automatic corotron cleaning process as shown in FIGS. 1-3 will be discussed in relation to the flowchart in FIG. 3 below.

FIG. 3 is a flowchart of an automatic corotron cleaning process in accordance with one possible embodiment of the disclosure. The method begins at 3100, and continues to 3200 where the corotron management unit 250 may receive a first dynamic current reading from the dynamic current monitor 255. The dynamic current monitor 255 may monitor the dynamic current from the transfer power supply. Dynamic current may be the current that is supplied to the photoreceptor of the image production device 100, for example. The corotron may be any corotron dynamic current controlled corona emitting device, such as a charge scorotron, pretransfer corotron, detack corotron and preclean corotron, for example.

At step 3300, the corotron management unit 250 may determine if the first dynamic current reading exceeds a predetermined threshold. The predetermined threshold may be a threshold set on the allowable variation in the dynamic current value, for example. Thus, for very high print quality, the predetermined threshold may be a variation in dynamic current of 10%, for example. However, in some other machines, the predetermined threshold may be a variation in dynamic current of 30-40%, for example. As such, the predetermined threshold may be determined by the default resolution of the image production device 100, for example.

If the corotron management unit 250 determines that the first dynamic current reading do not exceed the predetermined threshold, the process may go to step 3900, and end. The corotron management unit 250 may also send a signal to the image production device 100 to return to normal operation.

If at step 3300, the corotron management unit 250 determines that the first dynamic current reading exceeds the predetermined threshold, then at step 3400, the corotron management unit 250 may send a signal to a cleaning device to clean the corotron. The cleaning device may be an auto cleaner, for example. The cleaning device may be activated at the next appropriate cycle time, for example.

At step 3500, the corotron management unit 250 may determine if the corotron has been cleaned. The corotron management unit 250 may determine that the corotron has been cleaned by receiving a signal from the cleaning device or cleaning device controller, for example. If the corotron management unit 250 determines that the corotron has not been cleaned, the process returns to step 3500.

If the corotron management unit 250 determines that the corotron has been cleaned, at step 3600 the corotron management unit 250 may receive a second current reading from the dynamic current monitor 255. At step 3700, the corotron management unit 250 may determine if the second dynamic current reading exceeds the predetermined threshold. If the corotron management unit 250 determines that the second dynamic current reading does not exceed the predetermined threshold, the process may go to step 3900 and end.

If at step 3700 the corotron management unit 250 determines that the second dynamic current reading exceeds the predetermined threshold, then at step 3800, the corotron management unit 250 may send a signal to prompt a user to replace the corotron in the image production device 100. The corotron management unit 250 may send the corotron replacement signal to the user interface 270 of the image production device 100 or to a remote repair facility so it may be acted on by a technician, for example. The process may then go to step 3900 and end.

Figure 4A:
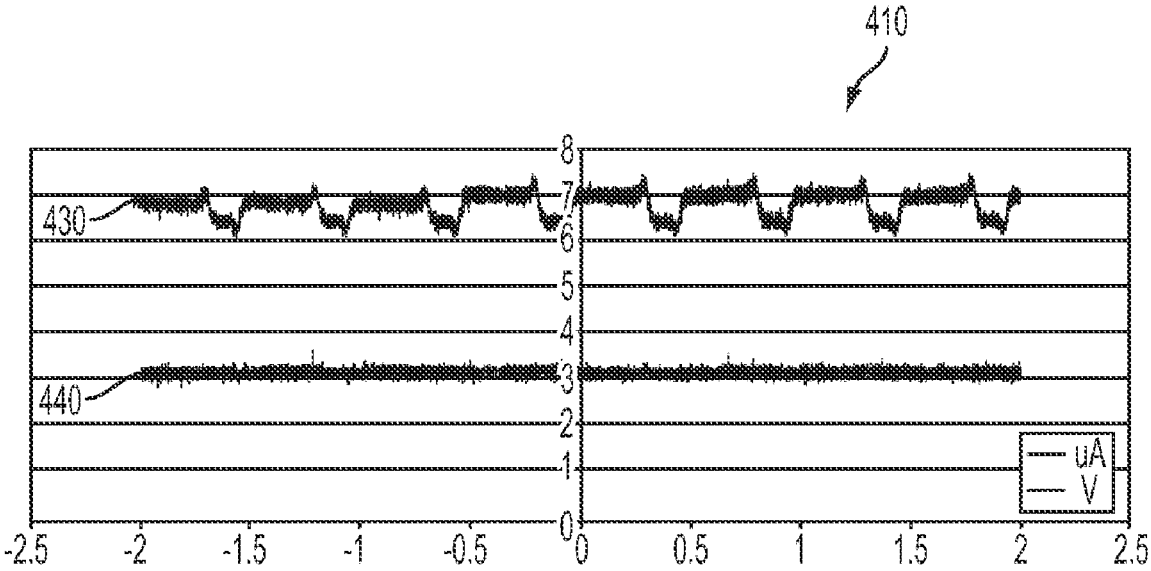
FIGS. 4A and 4B are graphs of dynamic current and voltage readings for a clean corotron and a dirty corotron, respectively, in accordance with one possible embodiment of the disclosure.
Figure 4B:
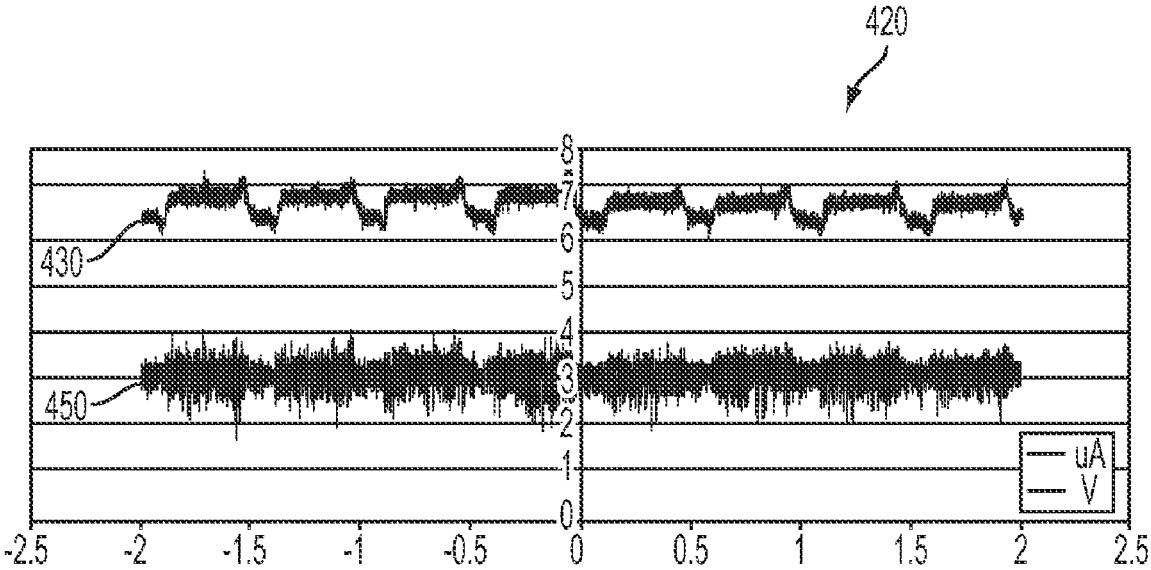

FIGS. 4A and 4B are graphs of dynamic current and voltage readings for a clean corotron and a dirty corotron, respectively, in accordance with one possible embodiment of the disclosure. FIG. 4A illustrates a graph 410 of dynamic current readings 440 and voltage readings 430 for a clean (or new) corotron. As shown, while the voltage readings 430 jump to compensate for a load, the dynamic current readings 440 remain stable and within an acceptable predetermined threshold or range.

In contrast, FIG. 4B illustrates a graph 410 of dynamic current readings 450 for a dirty corotron with the relatively same voltage readings 430 as in FIG. 4A. As shown, while the voltage readings 430 jump to compensate for a load, the dynamic current readings 450 are no longer stable and vary beyond an acceptable predetermined threshold. Thus, the corotron management unit 250 may then signal the cleaning device to clean the corotron or if the cleaning is unsuccessful, signal the user that the corotron needs replacement.

Figure 5:
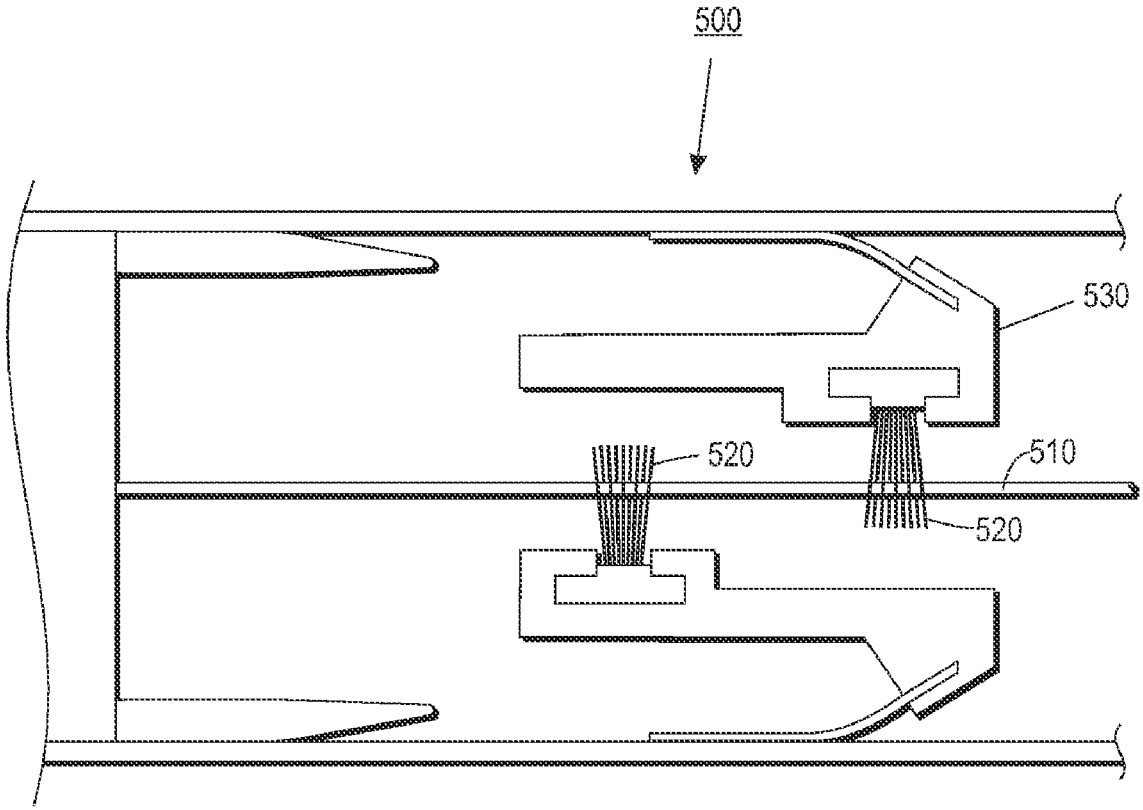
FIG. 5 is a diagram of an exemplary cleaning device in accordance with one possible embodiment of the disclosure.

FIG. 5 is a diagram of an exemplary cleaning device 500 in accordance with one possible embodiment of the disclosure. The cleaning device 500 cleans the corotron 510 (or other corona emitting device) using wipers 520, for example. The bracket 530 holds the wipers and may traverse the length of the corotron 510 in at least one or both directions. Note that this is but one type of cleaning device 500 that may be used with the disclosed embodiments. Other types of cleaning devices 500 may also be used within the spirit and scope of this disclosure.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for automatic corotron cleaning in an image production device, comprising:

receiving a first dynamic current reading, the dynamic current being the current supplied to a photoreceptor of the image production device;

determining if the first dynamic current reading exceeds a predetermined threshold, the predetermined threshold being a threshold set on the allowable variation in the dynamic current value and being determined by the default resolution of the image production device, wherein if it is determined that the first dynamic current reading exceeds the predetermined threshold, sending a signal to a cleaning device to clean the corotron;

determining that the corotron has been cleaned;

receiving a second current reading;

determining if the second dynamic current reading exceeds the predetermined threshold, wherein if it is determined that the second dynamic current reading exceeds the predetermined threshold, sending a signal to prompt a user to replace the corotron in the image production device.

2. The method of claim 1, wherein if one of the first and the second dynamic current readings do not exceed the predetermined threshold, sending a signal to the image production device to return to normal operation.

3. The method of claim 1, wherein the cleaning device is an auto cleaner.

4. The method of claim 1, wherein the first and second dynamic current readings are received from a dynamic current monitor, the dynamic current monitor monitoring the dynamic current in the transfer power supply.

5. The method of claim 1, wherein the corotron is determined to have been cleaned by receiving a signal from the cleaning device.

6. The method of claim 1, further comprising:

sending a signal to a user interface on the image production device to display a warning to replace the corotron.

7. The method of claim 1, further comprising:

sending a signal to a remote repair facility that the corotron in the image production device is in need of replacement.

8. The method of claim 1, wherein the image production device is one of a copier, a printer, a facsimile device, and a multi-function device.

9. An image production device, comprising:

a dynamic current monitor that monitors the dynamic current from the transfer power supply, the dynamic current being the current supplied to a photoreceptor of the image production device; and a corotron management unit that receives a first dynamic current reading from the dynamic current monitor, determines if the first dynamic current reading exceeds a predetermined threshold, the predetermined threshold being a threshold set on the allowable variation in the dynamic current value and determined by the default resolution of the image production device, wherein if the corotron management unit determines that the first dynamic current reading exceeds the predetermined threshold, the corotron management unit sends a signal to a cleaning device to clean the corotron and determines that the corotron has been cleaned, receives a second current reading from the dynamic current monitor, determines if the second dynamic current reading exceeds the predetermined threshold, wherein if the corotron management unit determines that the second dynamic current reading exceeds the predetermined threshold, the corotron management unit sends a signal to prompt a user to replace the corotron in the image production device.

10. The image production device of claim 9, wherein if one of the first and the second dynamic current readings do not exceed the predetermined threshold, the corotron management unit sends a signal to the image production device to return to normal operation.

11. The image production device of claim 9, wherein the cleaning device is an auto cleaner.

12. The image production device of claim 9, wherein the corotron management unit sends a signal to activate the cleaning device if there is no print job pending.

13. The image production device of claim 9, wherein the corotron management unit determines that the corotron has been cleaned by receiving a signal from the cleaning device.

14. The image production device of claim 9, wherein the corotron management unit sends a signal to a user interface on the image production device to display a warning to replace the corotron.

15. The image production device of claim 9, wherein the corotron management unit sends a signal to a remote repair facility that the corotron in the image production device is in need of replacement.

16. The image production device of claim 9, wherein the image production device is one of a copier, a printer, a facsimile device, and a multi-function device.

17. A non-transitory computer-readable medium storing instructions for controlling a computing device for automatic corotron cleaning in an image production device, the instructions comprising:

receiving a first dynamic current reading, the dynamic current being the current supplied to a photoreceptor of the image production device;

determining if the first dynamic current reading exceeds a predetermined threshold, the predetermined threshold being a threshold set on the allowable variation in the dynamic current value and determined by the default resolution of the image production device, wherein if it is determined that the first dynamic current reading exceeds the predetermined threshold, sending a signal to a cleaning device to clean the corotron;

determining that the corotron has been cleaned;

receiving a second current reading;

determining if the second dynamic current reading exceeds the predetermined threshold, wherein if it is determined that the second dynamic current reading exceeds the predetermined threshold, sending a signal to prompt a user to replace the corotron in the image production device.

18. The non-transitory computer-readable medium of claim 17, wherein the image production device is one of a copier, a printer, a facsimile device, and a multi-function device.

* * * * *